United States Patent [19]

Takagi et al.

[11] Patent Number: 5,051,014

[45] Date of Patent: Sep. 24, 1991

[54] SHEET FEEDING APPARATUS

[75] Inventors: Kazuhiko Takagi, Nagoya; Rikuo Sonoda, Nishikasugai, both of Japan

[73] Assignee: Brother Kogyo Kabushiki Kaisha, Nagoya, Japan

[21] Appl. No.: 540,194

[22] Filed: Jun. 19, 1990

[30] Foreign Application Priority Data

Jun. 21, 1989 [JP] Japan ..... 1-158498

[51] Int. Cl.[5] ..... B41J 11/58

[52] U.S. Cl. ..... 400/625; 400/629; 271/116; 271/242; 271/902

[58] Field of Search ..... 400/605, 624, 625, 629; 271/116, 242, 402, 270, 258, 259, 265

[56] References Cited

U.S. PATENT DOCUMENTS

| | | | |
|---|---|---|---|
| 4,268,021 | 5/1981 | Rutishauser et al. | 400/625 |
| 4,606,663 | 8/1986 | Cristoph et al. . | |
| 4,687,302 | 8/1987 | Runzi | 400/629 |

FOREIGN PATENT DOCUMENTS

| | | | |
|---|---|---|---|
| 0123310 | 4/1984 | European Pat. Off. . | |
| 0151425 | 1/1985 | European Pat. Off. . | |
| 0199376 | 10/1986 | European Pat. Off. | 400/629 |
| 0087069 | 5/1983 | Japan | 400/624 |
| 0257266 | 12/1985 | Japan | 400/629 |
| 0202873 | 9/1986 | Japan | 400/625 |
| 0220874 | 10/1986 | Japan | 400/629 |
| 0077768 | 4/1988 | Japan | 400/624 |

OTHER PUBLICATIONS

"Paper Aligning Apparatus", IBM Tech. Discl. Bulletin, vol. 27, No. 1A, 6/84, pp. 216–217.

Patent Abstracts of Japan, unexamined applications in Field, vol. 10, No. 10, 77 446, 1-16-86.

*Primary Examiner*—Eugene H. Eickholt

*Attorney, Agent, or Firm*—Kane, Dalsimer, Sullivan, Kurucz, Levy, Eisele and Richard

[57] ABSTRACT

In a sheet feeding apparatus which is employable in a printer and the like, provided is a mechanism for removing sag of the printing sheet caused by backward feeding operation executed when the reverse line feed operation and so on. Further, the mechanism controls the sheet feeding operation so as to be executed without a disadvantage caused by backlash included in a gear mechanism for driving the sheet to be fed. Thus, the printing sheet is accurately set at a printing position.

14 Claims, 11 Drawing Sheets

SHEET FEEDING APPARATUS

BACKGROUND OF THE INVENTION

The present invention relates to a sheet feeding apparatus arranged to feed a sheet in forward and backward directions, more particularly to a sheet feeding apparatus capable of controlling feeding operation so as to be executed without a feeding error due to a backlash of gears for driving a sheet to be fed.

FIG. 1 is a sectional view of a printer as a sheet feeding apparatus.

A printer frame 1 rotatably supports a platen 2 around a platen shaft 2A. Below the platen 2, a plurality of pinch rollers (two rollers 5, 5 being shown in FIG. 1) for nipping and sending a cut sheet 3 are disposed along with the platen 2. In addition, a paper bail 8 movable toward and away from the platen 2 is also disposed against the platen 2. Further, a printing head 6 is mounted on a well-known carriage movable along the platen 2. A ribbon cassette 7 housing a printing ribbon is detachablly mounted on the carriage and is moved along the platen 2.

Over the platen 2, a sheet supply/receiving device 21 including a hopper 25 for stacking the cut sheets 3 in an overlapped state is disposed, the upper surface of the hopper 25 being inclined to the printer. The sheet supply/receiving device has a frame 22 comprising a pair of side frame members 22A and a front wall panel 22B extending between and supported by the side frame member 22A. The side frame members 22A have a pair of respective connector arms 23 engageable with the opposite ends of the platen shaft 2A. A pair of sheet guides 23A, 23B that are spaced from each other is disposed between and supported by the connector 23. On the frame 22 of the hopper 25, a drive roller 26 for separating the top cut sheet 3 from the other sheets and for sending it toward the platen 2 and a pair of rollers 27 and 28 disposed midway between the drive roller 26 and the platen 2 in the sheet sending direction for sending the sheet are disposed, the rollers 27 and 28 being contacted each other, the cut sheet 3 being passed between the rollers 27 and 28. The rollers 26, 27 and 28 are respectively mounted on shafts 26A, 27A and 28A around which the rollers are rotated.

FIG. 2 is a view outlining a meshing state between a platen gear 50 secured to the platen shaft **2*a* and a motor gear 51 connected to a shaft 10A of a first motor "MO" which is a drive source for driving the platen 2**. The first motor "MO" is a stepping motor.

FIGS. 3A and 3B are enlarged views showing the meshing state of both the gears. FIG. 3A is a view showing the meshing state of the platen gear 50 and the motor gear 51 when the cut sheet 3 is started to be forwardly fed from the left to the right of the drawing as indicated by an arrow "A". On the other hand, FIG. 3B is a view showing the meshing state of the platen gear 50 and the motor gear 51 when the cut sheet 3 is started to be backwardly fed from the right to the left of the drawing as indicated by an arrow "B". As apparently shown in the drawings, in a typical gear transmission mechanism, by considering various errors such as production error, mounting error, and thermal expansion which may occur in the gears, a proper clearance, or backlash, "t" is provided between the gears which are meshed. Thus, when the motor gear 51 is rotated from the forward direction to the backward direction or vice versa, the rotation of the platen gear 50 involves a delay corresponding to the backlash "t". Consequently, even if the motor gear 51 is rotated for a specific amount, the platen gear 50 insufficiently rotates. Thus, the sheet feeding operation cannot be precisely accomplished. For example, when characters are over-stuck, the printing positions deviate, resulting in degradation of the printing quality. In a prior art disclosed in Japanese Patent Provisional Publication SHO 60-31983, when the sheet is forwardly fed, the drive section is forwardly rotated for a specific feed amount; when the sheet is backwardly fed, the drive section is excessively and backwardly rotated for a specific amount which is greater than the specific amount and then the drive section is forwardly rotated for the extra amount so as to prevent the feed error due to the backlash.

However, in the typical printer as illustrated in FIG. 1, when the sheet is forwardly fed, the platen 2 is driven in synchronization with the rollers 27 and 28. Conversely, when the sheet is backwardly fed, the platen 2 is backwardly rotated, but the rollers 27 and 28 and the drive roller 26 are not rotated because the subsequent stacked sheet is not backwardly fed. Thus, when the sheet is backwardly fed, since the rollers 27 and 28 are in non-rotatable state, they cannot send the cut sheet 3. Consequently, as shown in FIG. 4 of an outlined view of the sending state of the sheet, the cut sheet 3 is sagged midway between the platen 2 and the rollers 27 and 28.

In the following manner, the platen 2 is controlled so as to prevent the feed error due to the backlash with the manner described in the above prior art. First, the motor gear 51 is driven by the first motor "MO" for the specific extra amount which is greater than the specific retreating amount and the platen 2 is reversely rotated. At that time, the gears are meshed as shown in FIG. 3B. Then, likewise, when the motor gear 51 is driven for the extra amount and the platen 2 is forwardly rotated, the gears are meshed as shown in FIG. 3A.

However, when the cut sheet 3 is backwardly fed as described above, the cut sheet 3 is sagged between both the rollers. A restoring force is applied to the cut sheet 3, thereby causing the platen 2 to be forwardly rotated from the state shown in FIG. 3A.

Thus, the platen 2 is advanced for the amount of the backlash "t". If the platen 2 is forwardly rotated for the extra amount, the cut sheet 3 is excessively advanced for the amount of the backlash "t" of the gears. Consequently, the cut sheet 3 cannot be precisely sent to the specified position, resulting in a deviation of the printing positions when an overstruck printing operation is executed.

SUMMARY OF THE INVENTION

It is therefore an object of the invention to provide an improved sheet feeding apparatus capable of accurately setting a printing sheet at a printing position.

Another object of the invention is to provide an improved sheet feeding apparatus arranged to feed a printing sheet without sag caused on the printing sheet by reverse feeding operation.

Still another object of the invention is to provide an improved printing apparatus capable of feeding the printing sheet without sag caused on the printing sheet by reverse feeding operation after a printing operation is executed.

For this purpose, according to one aspect of the present invention, there is provided a sheet feeding apparatus, comprising:

storing means for storing more than one cut-type sheet in a stacked state;

feeding means for feeding the topsheet of said stacked sheet in a predetermined direction;

another feeding means, provided at downstream side of said feeding means in said predetermined direction, for further feeding said topsheet having been fed by said feeding means; and controlling means for controlling said feeding means and said another feeding means in such a manner that feeding amount of said another feeding means becomes larger than that of said feeding means in case that both of said feeding means feed the sheet.

According to another aspect of the invention, there is provided a sheet feeding apparatus, comprising:

storing means for storing more than one cut-type sheet in a stacked state;

feeding means including a pair of roller members for feeding the topsheet of said stacked sheet only in a predetermined direction;

another feeding means, provided at downstream side of said feeding means in said predetermined direction and arranged to be driven by a predetermined gear mechanism, including a platen member rotatable in said predetermined direction and an opposite direction thereto for further feeding said topsheet having been fed by said feeding means, whereby sag occurs between said pair of roller members and said platen member when said topsheet is backwardly fed by said platen member; and controlling means for controlling said another feeding means so as to feed said topsheet with respect to the sag having been occurred in case that said topsheet has been backwardly fed and further forwardly fed by said platen member.

According to still another aspect of the invention, there is provided a printing apparatus, comprising:

storing means for storing more than one cut-type sheet on which a printing operation is to be executed in a stacked state;

feeding means including a pair of roller members for feeding the topsheet of said stacked sheet only in a predetermined direction;

another feeding means, provided at downstream side of said feeding means in said predetermined direction, including a platen member rotatable in said predetermined direction and an opposite direction thereto for further feeding said topsheet having been fed by said feeding means, whereby sag occurs between said pair of roller members and said platen member when said topsheet is backwardly fed by said platen member;

printing means for printing the desired character and/or symbol data on said topsheet having been fed by said platen member and located at a predetermined position; and controlling means for controlling said feeding means and said another feeding means in such a manner that the sag is removed as said top sheet is fed in case that said topsheet is backwardly fed and further forwardly fed after the printing operation.

DESCRIPTION OF THE ACCOMPANYING DRAWINGS

DESCRIPTION OF THE EMBODIMENTS

Figure 1:
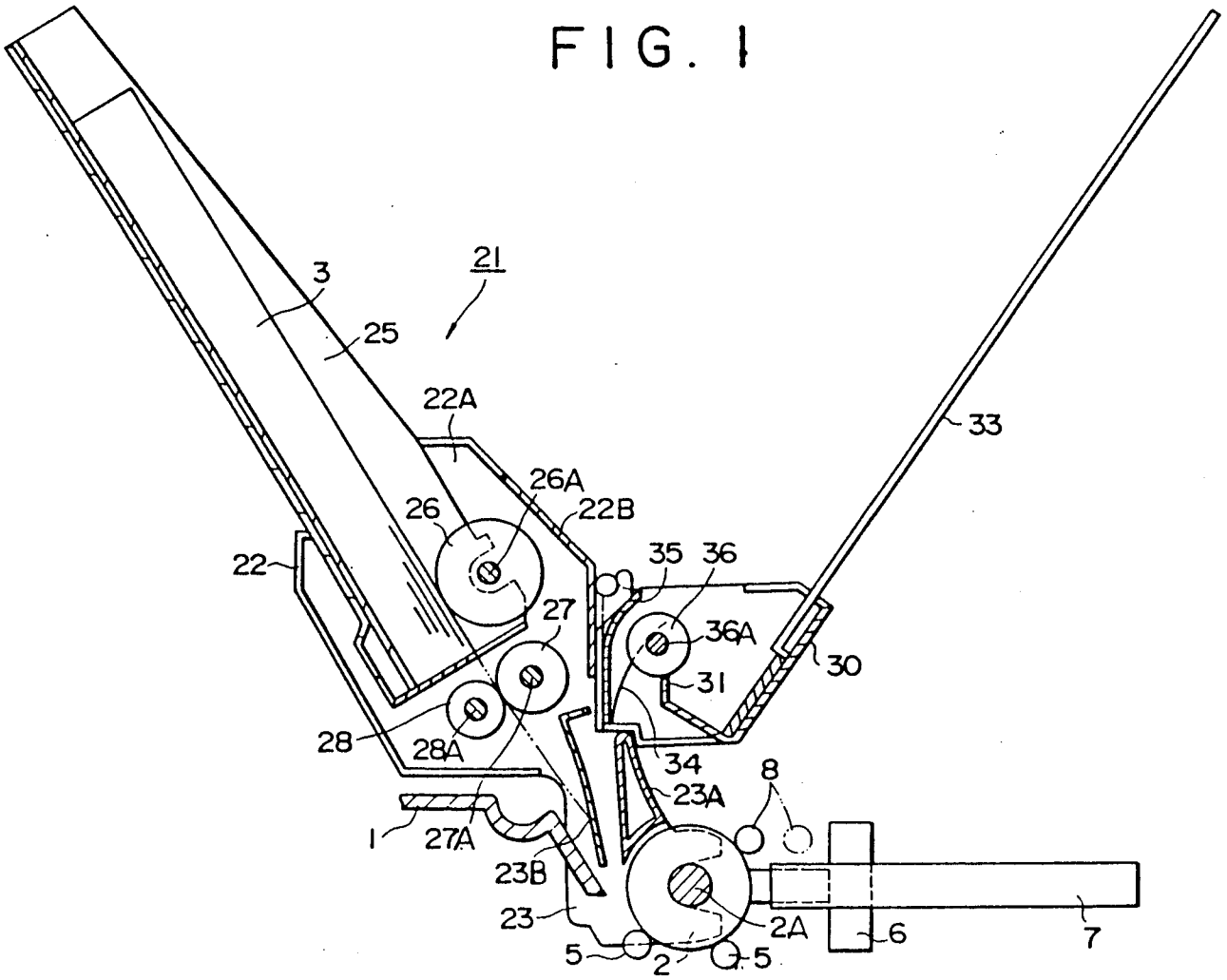
FIG. 1 is a sectional view of a printer as a sheet feeding apparatus according to the present invention.
Figure 2:
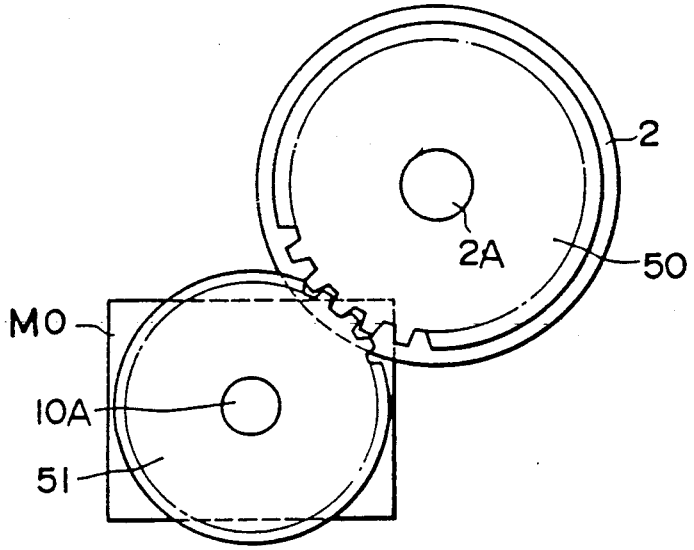
FIG. 2 is a side view showing a drive section for driving a platen accommodating in the printer of FIG. 1 to be rotated.

Referring to the drawings of FIGS. 1, 5 through 7, an operation and mechanical arrangements of a driving system of the printer as one embodiment according to the present invention will be described hereinafter.

In the printer of FIG. 1, a stacker 30 is mounted on the frame 22. The stacker 30 is in the form of a box which has upper and lower open sides and is slender in a direction parallel to the platen 2. The stacker 30 includes a support 31 disposed in a front lower portion thereof for supporting the lower end of the sheet 3 with its printed face projecting up from the support 31, the support member 33 having an upper end inclined forwardly of the printer. The stacker 30 has a rear wall serving as a guide wall 35. A feed roller 36 for delivering the sheet 3 fed from the platen 2 toward the support member 33 is disposed inwardly of the guide wall 35, and rotatably supported through its shaft 36A. A flexible film 34 for pressing the sheet 3 against the feed roller 36 is also disposed inwardly of the guide wall 35.

A driving system for driving the above rollers will be described hereinafter.

Figure 5:
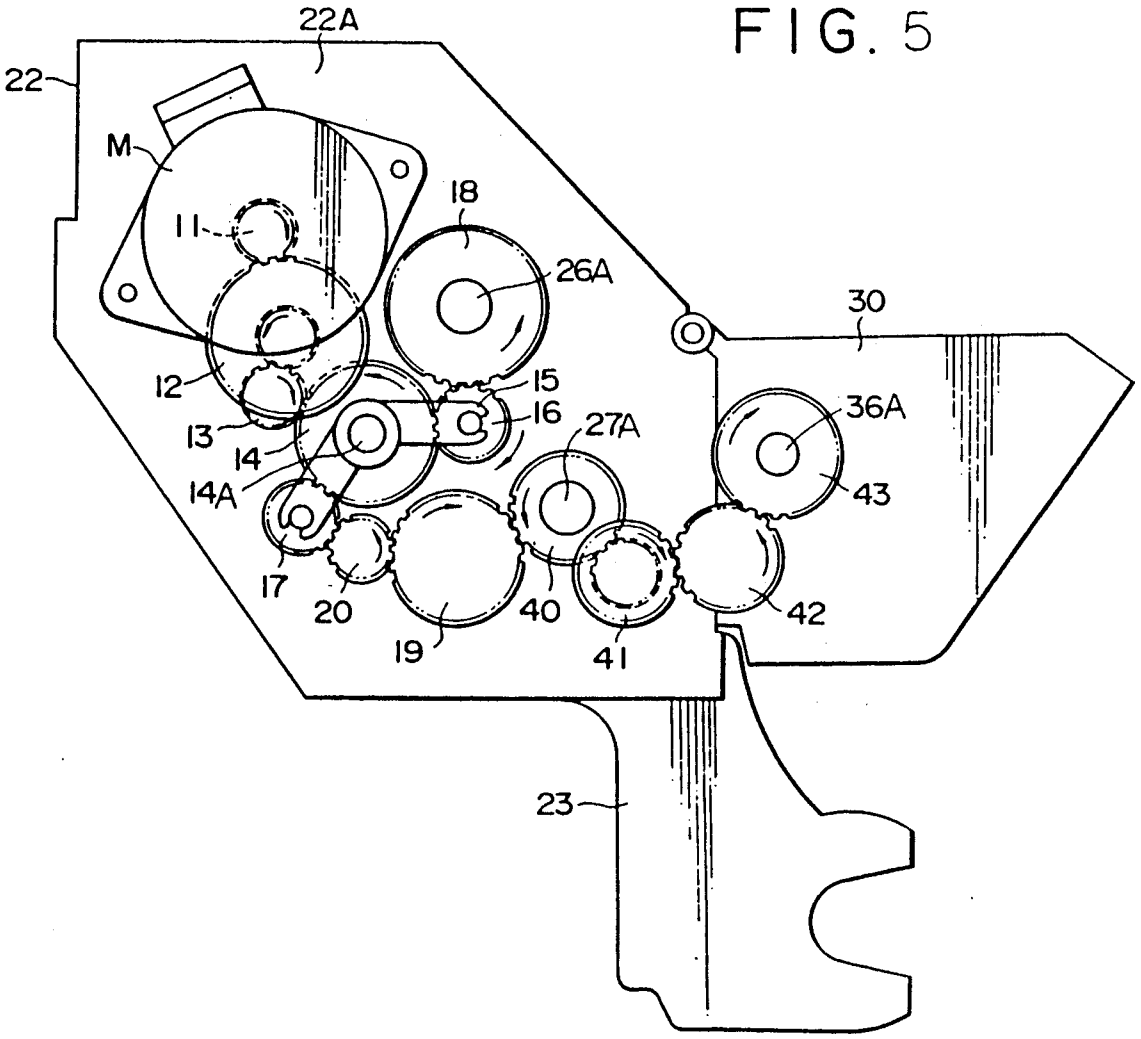
FIG. 5 is a sectional view of a feeding mechanism employed in the printer of FIG. 1.
Figure 6:
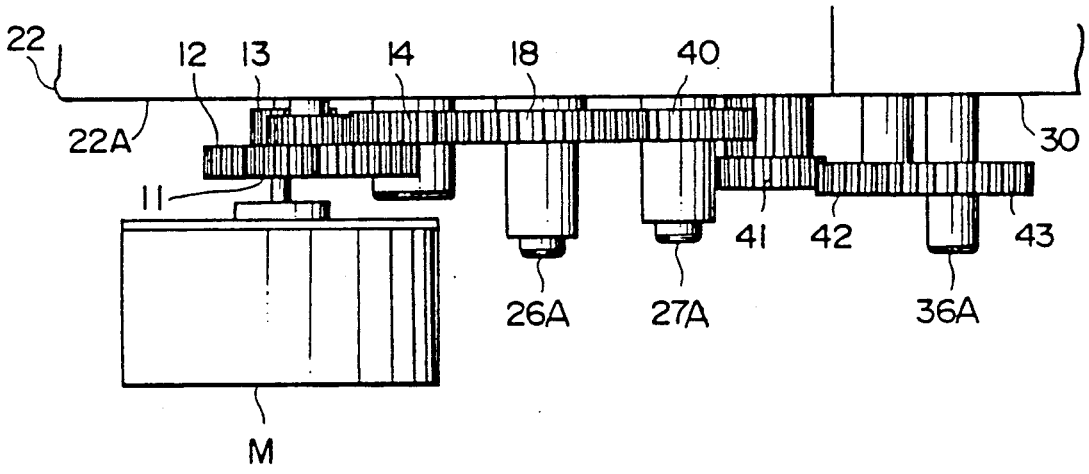
FIG. 6 is a plane view of the feeding mechanism of FIG. 5.

As shown in FIGS. 5 and 6, a drive gear 18, a gain feed gear 40 and a feed gear 43 are co-rotatably mounted on the shafts 26A, 27A and 36A of the drive roller 26, one of the pair of rollers 27 and the feed roller 36, respectively. Those gears 18, 40 and 43 are provided on the outer side of the side frame member 22A of the frame 22. A drive motor "M" energizable by electric pulses is disposed on the outer surface of the side frame member 22A. The drive motor "M" is a stepping motor. The drive motor "M" has a motor shaft which supports a motor gear 11 held in mesh with a large diameter gear of a speed-reduction gear assembly 12 composed of two gears of different radii. A power transmitting gear 14 is rotatably supported on the side frame member 22A near the speed-reduction gear assembly 12. Rotation of the speed-reduction gear assembly 12 is transmitted from the smaller-diameter gear thereof through an idler gear 13 to the power transmitting gear 14.

The power transmitting gear 14 has an integral central shaft 14A on which a swing arm 15 is swingably mounted at its intermediate portion. The swing arm 15 is frictionally coupled to the central shaft 14A so that the swing arm 15 can swing the central shaft 14A, but the central shaft slips with respect to the swing arm 15 when the latter is stopped. Main and auxiliary swing gears 16, 17 are rotatably mounted on the opposite ends, respectively, of the swing arm 15, and are held in mesh with the power transmitting gear 14.

Between the auxiliary swing gear 17 and the main feed gear 40, there are rotatably supported a pair of larger- and smaller-diameter idle gears 19, 20 for transmitting rotation of the auxiliary swing gear 17 to the main feed gear 40.

Figure 7:
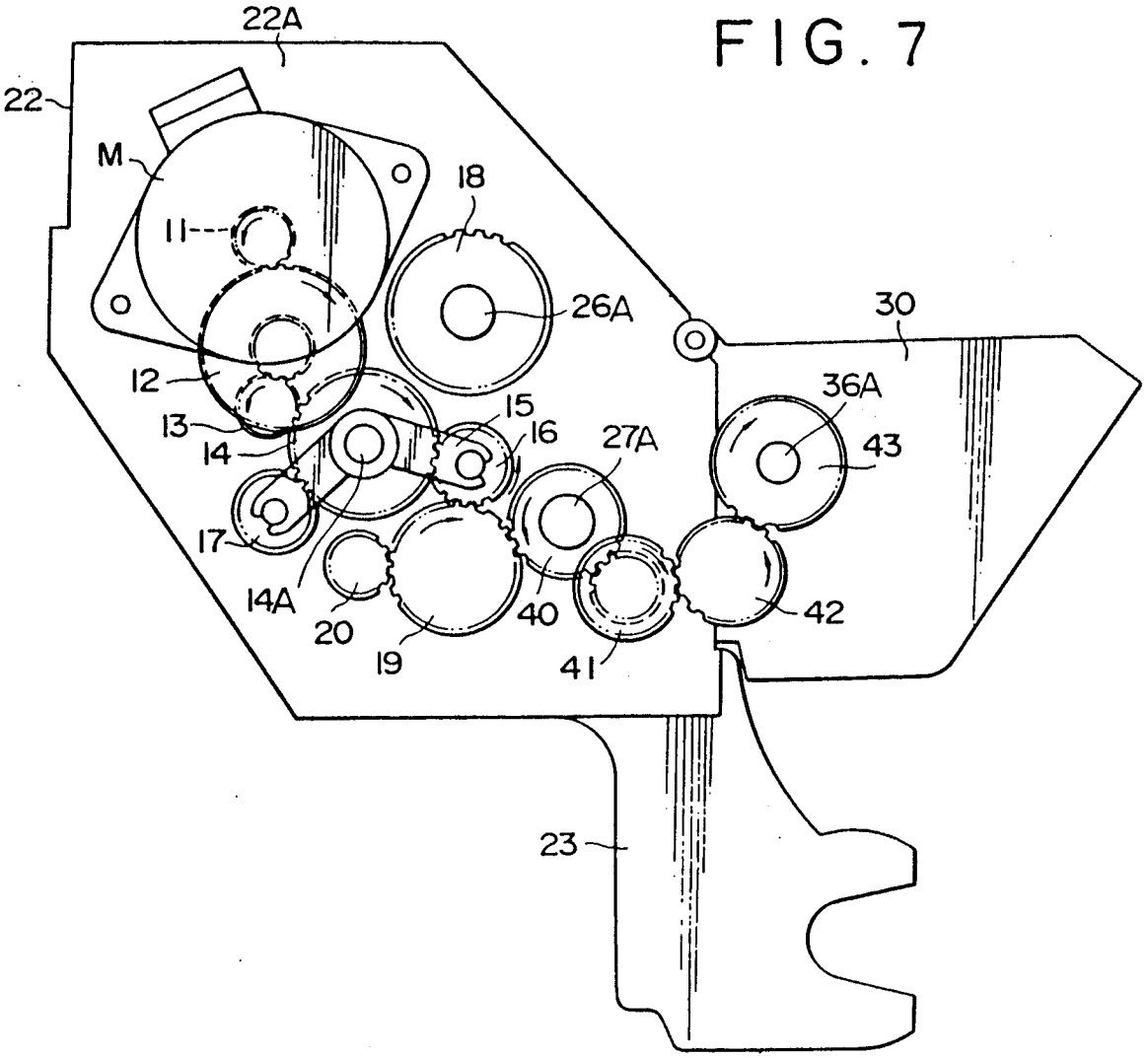
FIG. 7 is a sectional view of the feeding mechanism in another state comparing to FIG. 5.

As shown in FIGS. 5 and 7, the main swing gear 16 is in alternative mesh with the drive gear 18 or the larger-diameter gear 19 depending on swinging movement of the swing arm 15. The auxiliary swing gear 17 is selectively brought into and out of mesh with the smaller diameter idler gear 20 depending on swinging movement of the swing arm 15. When the main swing gear 16 meshes with the drive gear 18, the auxiliary swing gear 17 meshes with the idler gear 20. When the main swing gear 16 is in mesh with the idler gear 19, the auxiliary swing gear 17 is kept out of mesh with the idler gear 20. Therefore, the idler gear 19 is always kept in driven relation to the power transmitting gear 14 through either the main swing gear 16 or the auxiliary swing gear 17 and the idler gear 20.

Between the main feed gear 40 and the feed gear 43, there are disposed an idler gear 41 rotatably supported on the side frame member 22A and meshing with the main feed gear 40, and an idler gear 42 rotatably supported on an outer frame of the stacker 30 and meshing with the feed gear 43, the idler gear 41, 42 meshing with each other.

Figure 8:
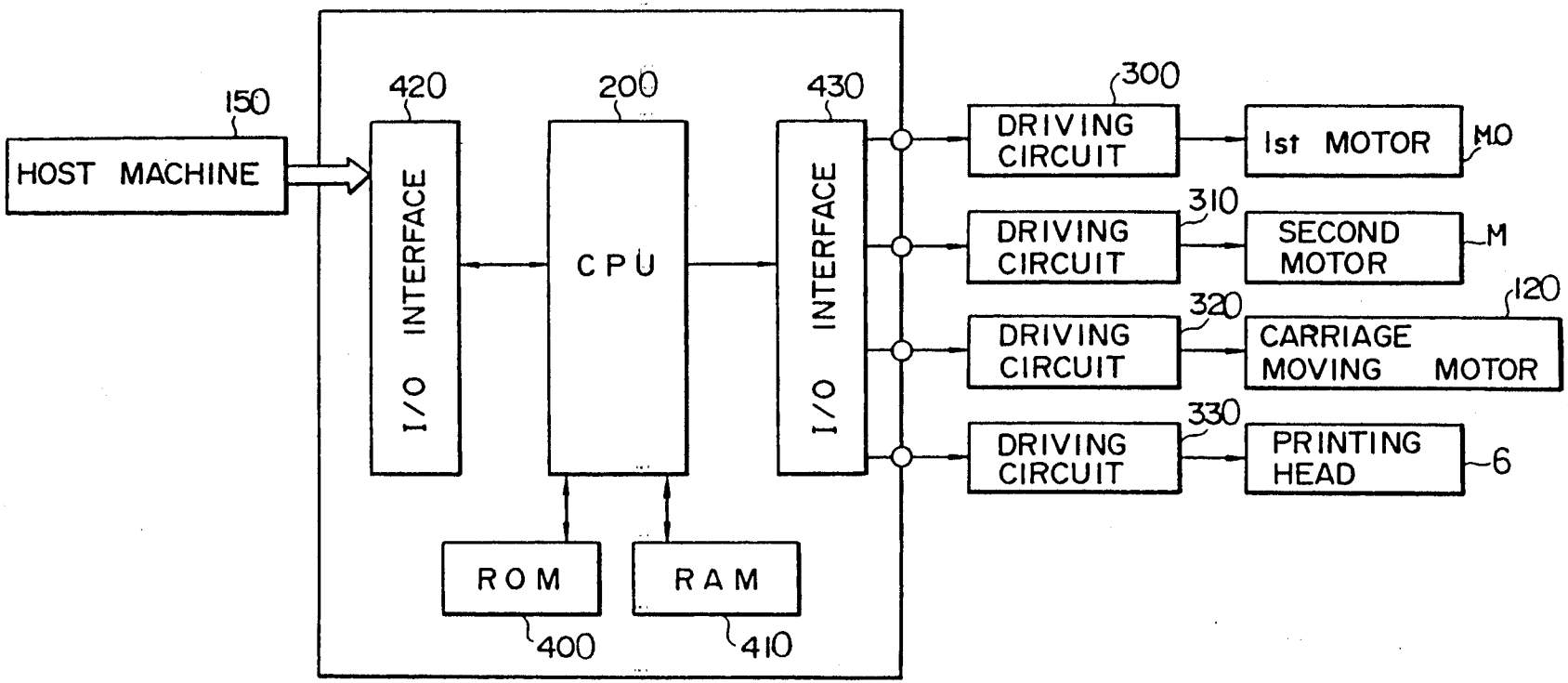
FIG. 8 is a block diagram of the printer of FIG. 1.

FIG. 8 shows a structural block diagram of the sheet feeding apparatus according to the present invention. In the drawing, 200 is a CPU (Central Processing Unit) for controlling various operations of a printer. The CPU 20 is connected to a ROM (Read Only Memory) 400 for storing programs executed under control of the CPU 200 and print patterns and to a RAM (Random Access Memory) 410 for temporarily storing print data sent from a host computer 150. The CPU 200 is connected via I/O (Input/Output) interfaces 420 and 430 to a drive circuit 300 for driving a first motor "MO" which is a drive source of the platen 2 and to a drive circuit 310 for driving the above motor "M" (defined as a second motor) which is a drive source of the drive roller 26 and pair of rollers 27 and 28. In addition, the CPU 200 is connected to a drive circuit 320 for driving a carriage moving motor 120 and to a drive circuit 330 for driving the printing head 6.

When the first motor "MO" is rotated forwardly and backwardly, the platen 2 is rotated in the direction where the sheet is advanced and in the direction where the sheet is retreated. On the other hand, as described above, when the second motor "M" is forwardly rotated, the drive roller 26 and the rollers 27 and 28 are rotated synchronously in the direction where the sheet is advanced, while, when the second motor 11 is rotated backwardly, the drive roller 26 becomes freely rotatable and the pair of rollers 27 and 28 are rotated in the direction where the sheet is advanced.

Figure 9:
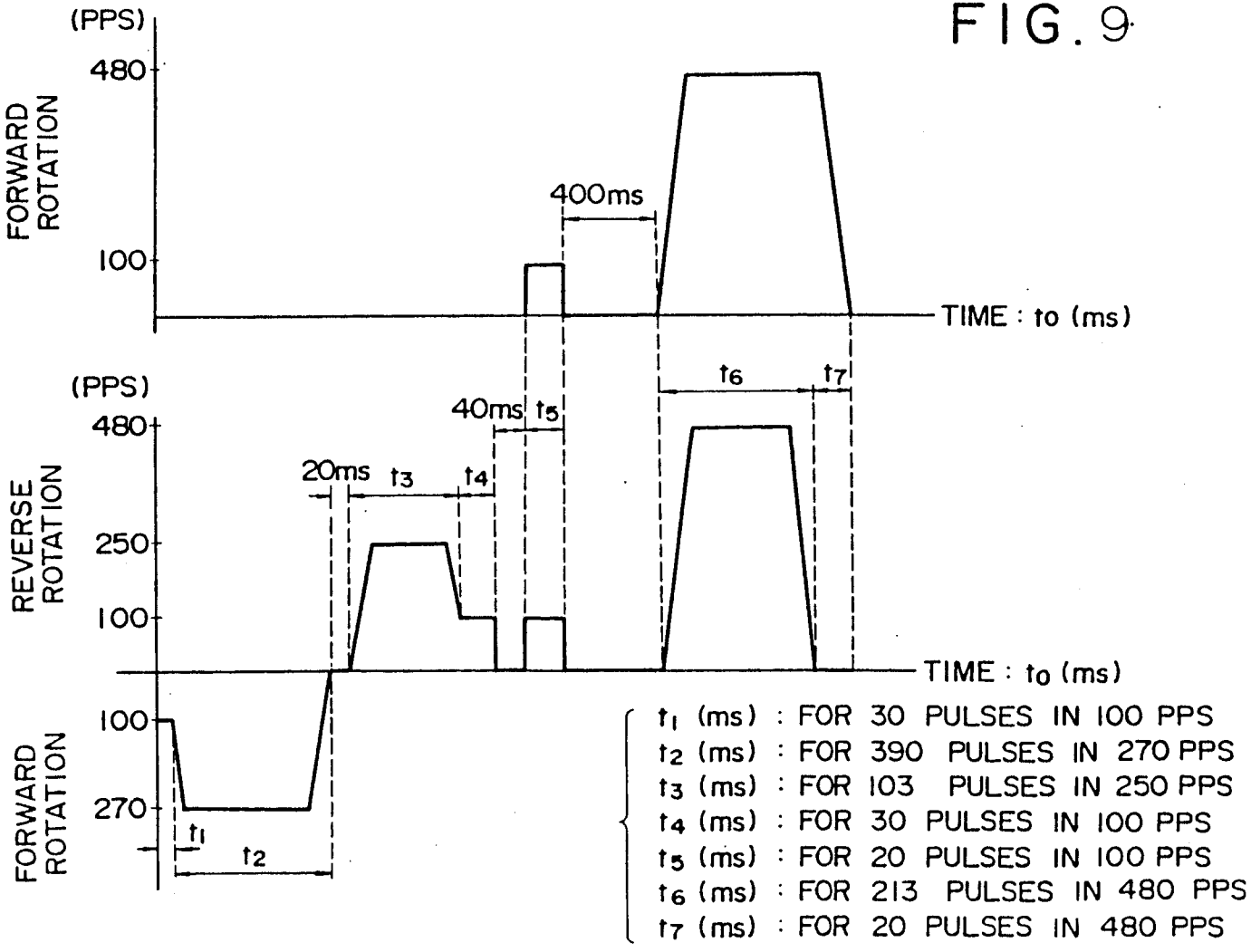
FIG. 9 is a characteristic schematic of driving motors for driving a printing sheet and a platen.

Now, by referring to a drive characteristic schematic illustrated in FIG. 9, the control operations executed by the first motor "MO" and the second motor "M" will be described hereinafter. The upper portion of the drawing is for the first motor "MO" and the lower portion is for the second motor "M".

The first motor "MO" and the second motor "M" are controlled by the CPU 20 through the drive circuits 300 and 310. As shown in FIG. 1, while the cut sheets 3 are stacked in the hopper 25, the second motor "M" is forwardly rotated for 30 pulses at 100 pps (pulses/-second) and then for 390 pulses at 270 pps. As the second motor "M" is rotated, the motor gear 11 is rotated in a forward direction as shown in FIG. 5, causing the speed reduction gear assembly 12 and the idler gear 13 to rotate the power transmitting gear 14 counterclockwise. The central shaft 14A of the power transmitting gear 14 is rotated to angularly move the swing arm 15 in the same direction frictional contact therewith. After that, the top sheet of the cut sheets 3 stacked in the hopper 25 is separated from the subsequent ones and sent to the rollers 27 and 28.

The counterclockwise rotation of the swing arm 15 brings the auxiliary swing gear 17 into mesh with the idler gear 20. Thus, rotation of the auxiliary swing gear 17 is transmitted through the idler gears 19, 20 to the main feed gear 40, which rotates the pair of rollers 27 and 28 which rotates in compliance with the roller 27 cooperate with each other in sending the sheet 3 in a predetermined interval along the sheet guide 23B while the sheet 3 is being gripped by the pair of rollers 27 and 28.

Figure 4:
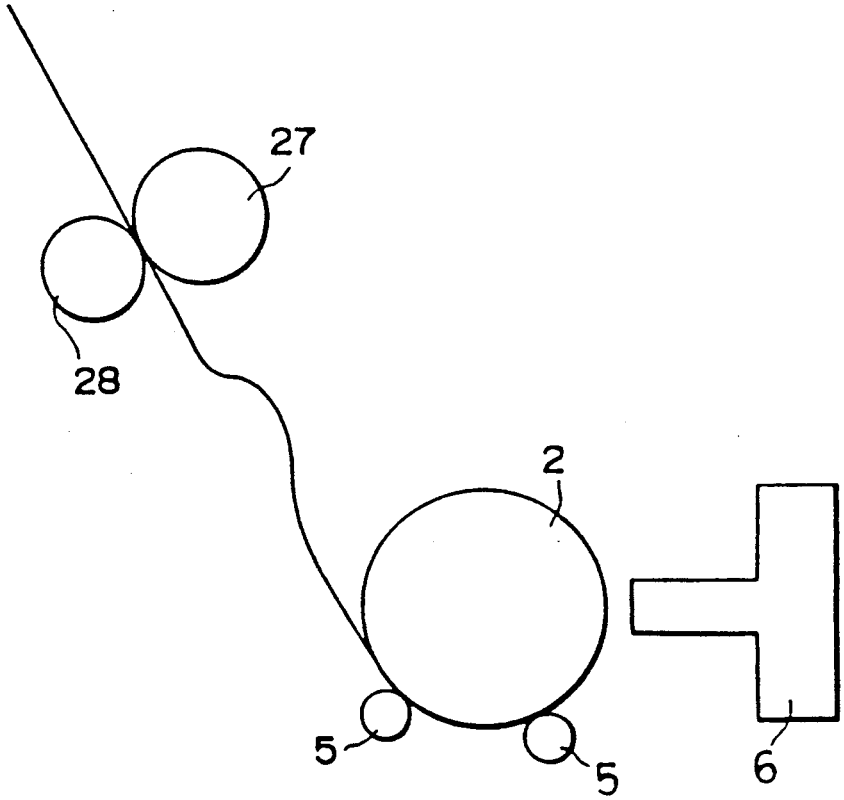
FIG. 4 is an outlined schematic showing a feeding state when sag is occurred.

Next, the second motor "M" is stopped for 20 (ms) and then rotated for 103 pulses at 250 pps. The rotation of the second motor "M" is transmitted through the motor gear 11, the speed reduction gear assembly 12, and the idler gear 13 to the power transmitting gear 14, thereby rotating the power transmitting gear 14 clockwise. The swing arm 15 is now turned clockwise to displace the main swing gear 16 out of mesh with the drive gear 18 and also to displace the auxiliary swing gear 17 out of mesh with the idler gear 20. Only the main swing gear 16 is brought into mesh with the idler gear 19 to transmit the rotation to the idler gear 19, which is rotated clockwise in the same manner as shown in FIG. 5. Therefore, after the sheet 3 has been gripped between the pair of rollers 27 and 28, the drive roller 26 rotated by the second motor "M" becomes free. The pair of rollers 27 and 28 are rotated by the second motor "M" and the cut sheet 3 is sent toward the platen 2. After that, when the second motor "M" is backwardly rotated for 30 pulses at 100 pps, while the platen 2 is not rotated, the pair of rollers 27 and 28 are rotated in the direction where the cut sheet 3 is sent. Thus, the cut sheet 3 is sent for a longer distance than that between the hopper 25 and the platen 2. At that time, the end of the cut sheet 3 is contacted with the engaged portion between the platen 2 and a pinch roller 5 so that the cut sheet 3 is sagged as shown in FIG. 4. Thus, the leading end of the cut sheet 3 is arranged between the platen 2 and the pinch roller 5 by causing the sag along a width direction.

After that, the second motor "M" is stopped for 40 (ms) and then backwardly rotated for 20 pulses at 100 pps. In synchronization with the backward rotation of the second motor "M", the first motor "MO" is forwardly rotated and thereby the platen 2 is rotated in the counterclockwise direction in FIG. 4. As the platen 2 is rotated, the cut sheet 3 is slightly moved to the print position and securely positioned between the platen 2 and the pinch roller 5. For 400 (ms) until the paper bail 8 is temporarily separated from the platen 2 by a well-known operation unit as shown by the dot line in FIG. 1, the power supply to the first motor "MO" and the second motor "M" is stopped.

In synchronization with the backward rotation of the second motor "M" for 213 pulses at 480 pps, the first motor "MO" is also forwardly rotated. Thus, the end of the cut sheet 3 is sent by the platen 2 and the pair of rollers 27 and 28 to the print position, that is, to the slightly upward direction of the paper bail 8 shown in FIG. 1. After that, the first motor "MO" is forwardly rotated and the second motor "M" is stopped. In other words, for the last 20 pulses, while the pair of rollers 27 and 28 are stopped, only the platen 2 is rotated in the counterclockwise direction of FIG. 1. With this operation, the sending amount of the cut sheet 3 by the platen 2 becomes greater than that by the pair of rollers 27 and 28 and the sagging of the cut sheet 3 shown in FIG. 4 is removed.

After that, the paper bail 8 is returned to the position where it is in contact with the platen 2. The cut sheet 3 is nipped by the platen 2 and the paper bail 8 and the sending operation of the cut sheet 3 to the print position is completed.

Thereafter, the sheet 3 is printed by the print head 6, and then delivered into the stacker 30 by the platen 2 which is rotated. The sheet 3 is introduced between the guide wall 35 and the support 31 into a position between the feed roller 36 and the flexible film 34. After the sheet 3 has been printed over one page, the leading end of the sheet 3 is gripped between the feed roller 36 and the flexible film 34, whereupon the second motor "M" is reversely rotated. The main feed roller 40 is rotated to cause the idler gear 41, 42 and the feed gear 43 to rotate the feed roller 36 for thereby stacking the printed sheet 3 onto the support member 33 of the stacker 30.

Figure 10:
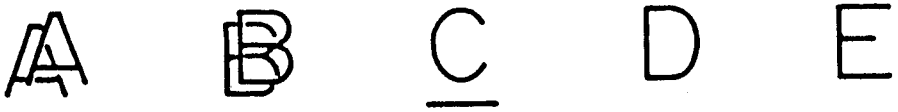
FIG. 10 is a schematic showing a printing example.

In the printer structured as described above, as shown in FIG. 10, by referring to a flowchart of FIG. 11, a sheet feeding operation, for printing letters "A" and "B" in a secondary color (mixed color of two colors), "C" with an under line, and "D" and "E" as normal printing, will be described.

Figure 12:
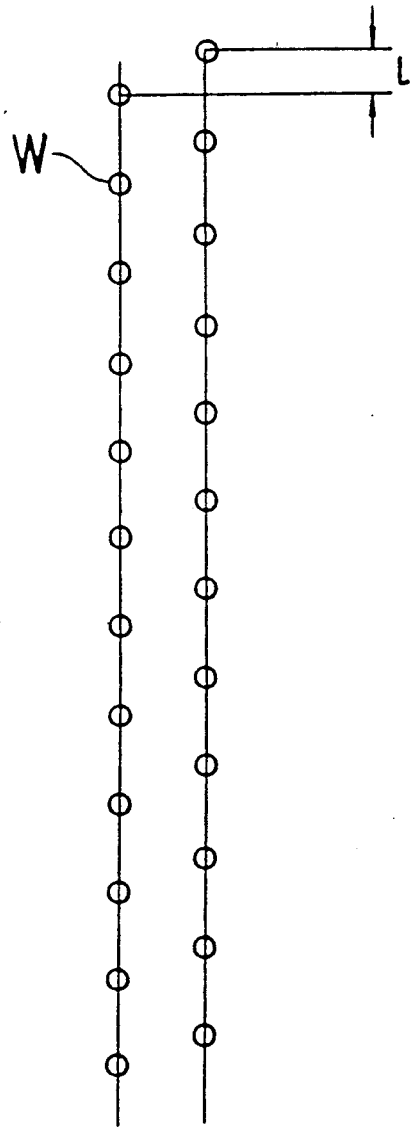
FIG. 12 is a schematic showing pin-assignment of the printing head accommodated in the printer of FIG. 1.

FIG. 12 shows a pin assignment of the printing head 6 viewed from the platen 2 side. The printing head 6 is structured with 24 pins where two rows of 12 pins are disposed in a zigzag pattern. The length "1" between two pins is 1/18 inch. The printing head 6 is controlled so that an underline is printed with the fourth pin "w".

Figure 11:
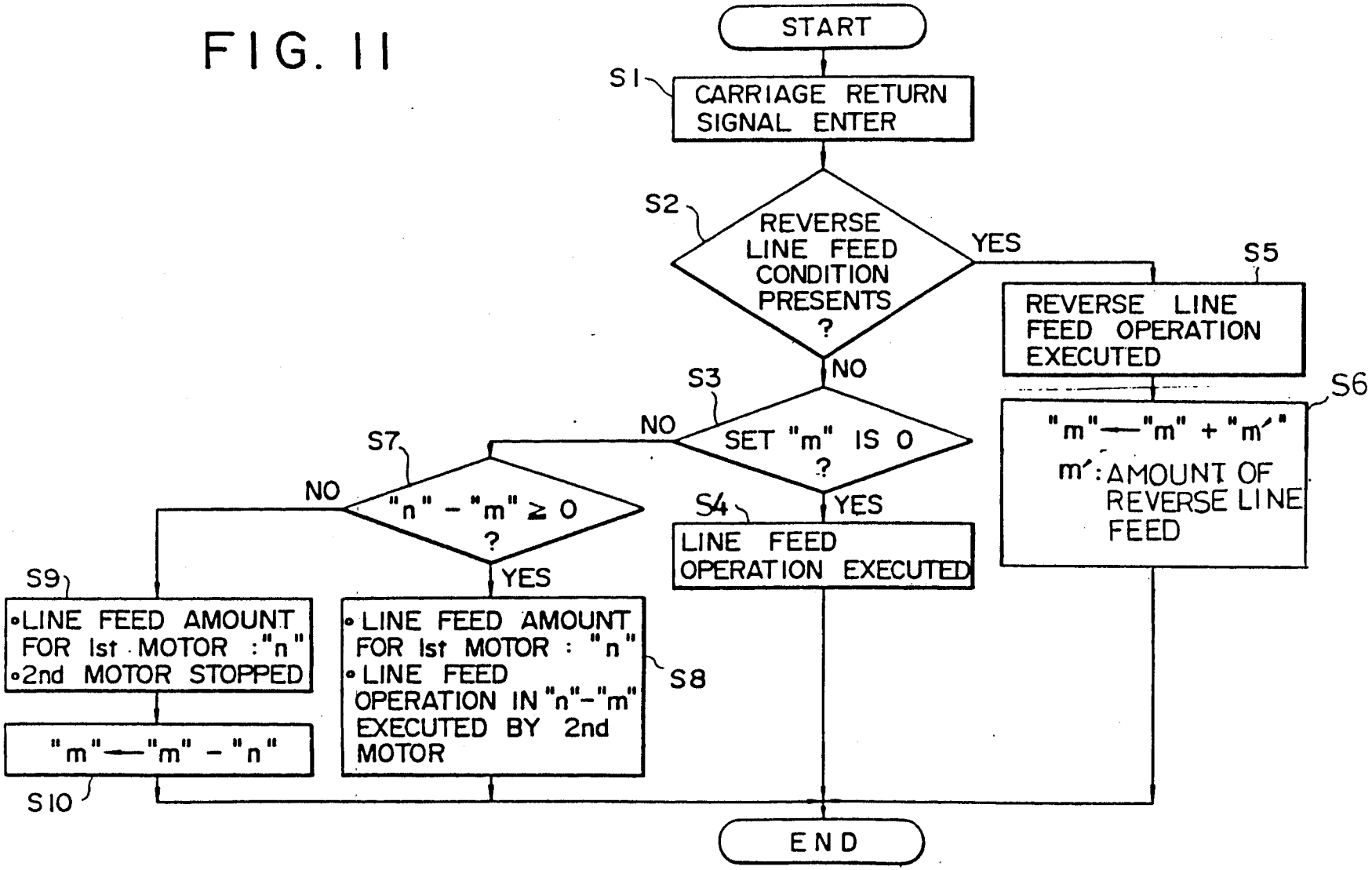
FIG. 11 is a flowchart for explaining an operation of the sheet feeding apparatus according to the present invention.

A line feed in the flowchart of FIG. 11 means an advancement of the cut sheet 3, while a reverse line feed thereof means a retreat of the cut sheet 3.

The CPU 200 controls the drive circuit 330 via the interface 430. The drive circuit 330 drives the printing head 6 so as to print normal letters, that is, "A, B, C, D, E".

Figure 3A:
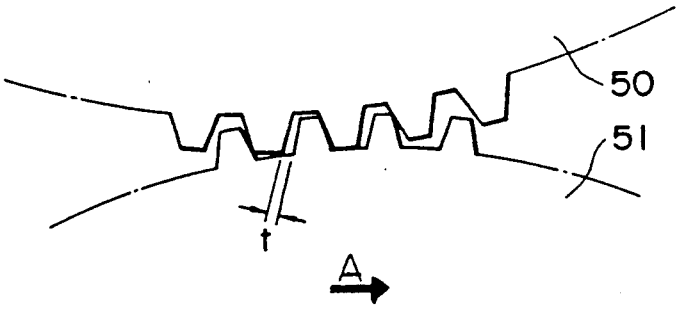
FIGS. 3A and 3B are partially enlarged views of FIG. 8.
Figure 3B:
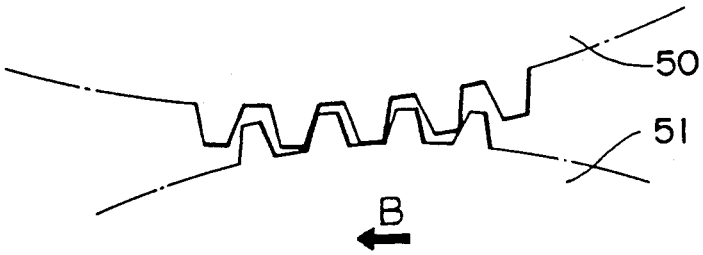

In step S1 of the flowchart of FIG. 11, a line feed operation signal for printing an underline is entered. In step S2, it is determined whether or not a reverse line feed condition, that is, a condition for retreating the cut sheet 3 is present. In this case, since a line feed is performed for printing an underline, the determined condition becomes "NO" and the process is advanced to step S3. In step S3, it is determined whether or not the value "m", described later, is "0". Since the value "m" is the sagging amount of the cut sheet 3 which is present between the platen 2 and the pair of rollers 27 and 28, the value "m" becomes "0" and thereby the determined condition becomes "YES". The process is advanced to step S4. In step S4, since an underline is printed with the fourth pin "w" as described above, a line feed operation for (24+4) pins, that is, for 28/180=7/45 inch is performed by the first motor 10. Thus, the line feed operation is completed. After that, the drive circuit 320 drives the carriage moving motor 120 so as to move the carriage to the letter "C" and to cause printing head 6 to print the underline below the letter "C" having been already printed. After that, a line feed operation signal for printing letters "A" and "B" in another color is entered in step S1. In step S2, since a reverse line feed condition is present, the determined condition becomes "YES" and the process is advanced to step S5. In step S5, a reverse line feed operation for the amount of the line feed advanced for printing the underline, that is, for 28/180=7/45 inch is performed. At that time, the drive circuit 300 drives the first motor "MO" so as to cause the platen 2 to be backwardly rotated. At that time, to remove the feed error due to the backlash "t", the first motor "M" is backwardly rotated for the amount which is for the specific extra amount "d", greater than that of the line feed of 7/45 inch. The specific extra amount "d" is equal to or greater than the backlash "t", i.e., a relationship $d>t$ is satisfied. At that time, the motor gear 51 is meshed with the platen gear 50 as shown in FIG. 3B. Accordingly, the platen 2 is backwardly rotated in an amount corresponding to the value indicated by a formula $7/45+(d-t)$. When the platen 2 is backwardly rotated, since no power is supplied to the second motor "M", the pair of rollers 27 and 28 are not rotated and thereby the cut sheet 3 being retreated is sagged midway between the platen 2 and the pair of rollers 27 and 28 as shown in FIG. 4. Then, the platen 2 is forwardly rotated. At that time, the motor gear 51 and the platen gear 50 are meshed as shown in FIG. 3A. However, the restoring force of the cut sheet 3 causes the sagging thereof to be removed. Thereby, the cut sheet 3 causes the platen 2 in contact with the pinch roller 5 to be forwardly rotated for the amount of the backlash "t" and thereby the gears are meshed as shown in FIG. **3*b*. Thus, the first motor "MO" is controlled so that the amount of the rotation of the first motor "MO" becomes that where the backlash "t" is subtracted from the extra amount "d", that is, $(d-t)$. In step S6, the amount of reverse line feed is set to "m" where the amount of reverse line feed which has been performed is added to the amount of sagging of the cut sheet 3. In this case, m is set to 7/45 inch. Thus, the reverse line feed operation for over-striking letters is completed. After that, the carriage is moved and the printing head 6** over-strikes letters "A" and "B" on the same letters using another ink ribbon to indicate a secondary color.

With the sequence of operations described above, the printing of one line is completed. After the printing of one line is completed, the line feed operation signal for performing the line feed operation until the subsequent line is entered in step S1. In step S2, since the reverse line feed condition is absent, the determined condition becomes "NO" and the process is advanced to step S3. In step S3, it is determined whether or not the value "m" is 0. Since "m" has been set to 7/45, as described above, the determined condition becomes "NO" and the process is advanced to step S7.

In step S7, the subtraction of $(n-m)$, $(n-m)$, "n": line feed amount;

is computed and then it is determined whether or not the result of the above subtraction is 0 or more.

Generally, "n" has been set to 1/6 inch. Thus, in step S7, the determined condition becomes "YES" and the process is advanced to step S8. Thus, the CPU 200 controls the drive circuit 300 via the interface 430 so as to drive the first motor "MO". Thereby, the platen 2 is forwardly rotated and the cut sheet 3 is advanced. Since the sagging of the cut sheet 3 causes the platen 2 to be forwardly rotated, the motor gear 51 and the platen gear 50 are meshed as shown in FIG. 3B. Thus, the amount of forward rotation of the platen 2 is for the amount of backlash "t" larger than that for advancing the cut sheet 3 for "n"=1/6 inch.

On the other hand, the CPU 200 controls the second motor "M" via the drive circuit 310. Since the cut sheet 3 is sagged for "m" between the platen 2 and the pair of rollers 27 and 28 as shown in FIG. 4, the pair of rollers 27 and 28 are rotated so that the cut sheet 3 is advanced for (n−m), that is, 1/6−7/45=1/90 inch in step S6.

As described above, the CPU 200 controls the first motor "M" and the second motor "MO" so that the amount of rotation of the platen 2 differs from that of the pair of rollers 27 and 28 and thereby the sagging of the cut sheet 3 which occurred in step S5 is removed. When such sagging is removed, the platen 2 can be driven in synchronization with the pair of rollers 27 and 28.

On the other hand, when an operator sets the line feed amount "n" to a value which is smaller than the sagging amount "m", the determined condition in step S7 becomes "NO" and the process is advanced to S9. In step S9, the first motor "MO" rotates the platen 2 for "n", while the second motor "M" stops. In addition, the value "m" where the line feed amount is subtracted from the remaining sagging amount is set in step S10.

When vertically enlarged letters are printed, the following sequence of operations are performed. First, in step S5, the reverse line feed operation of the cut sheet 3 is performed from the position where regular letters are printed. In this case, likewise, by considering the backlash "t", the cut sheet 3 is retreated for the specific extra amount "d" and then the platen 2 is forwardly rotated for the amount where it is rotated by the cut sheet 3, that is, for the amount where the backlash "t" is subtracted. Thus, m=24/180=2/15 is set. After that, the upper half portion of each of vertically enlarged letters is printed and the cut sheet 3 is advanced for n=24/180=2/15 inch. However, the amount of forward rotation of the platen 2 to be driven becomes that for the backlash "t" larger than "n" as described above. In step S7, "n"−"m" becomes 0. In step S8, the second motor "M" is powered, but not driven. Thus, the pair of rollers 27 and 28 are not rotated. The lower half portion of each of vertically enlarged letters is printed.

As was described above, when the CPU 200 causes the cut sheet 3 to be retreated, it controls the drive circuit 300 by considering the backlash "t". Thus, the sheet feed operation can be precisely performed without a feed error due to the backlash "t".

What is claimed is:

1. A sheet feeding apparatus, comprising:

a hopper member capable of storing a plurality of said cut-type sheets in a stacked state;

feeding means for feeding a topsheet of said stacked sheets in a predetermined direction, said feeding means comprises a feed roller member for feeding said topsheet adapted to be brought into contact with said topsheet and a pair of roller members provided on a downstream side of said feed roller for feeding said topsheet having been fed by said feed roller member therebetween;

another feeding means, provided at a downstream side of said feeding means in said predetermined direction, said another feeding means comprising a platen member provided downstream of said pair of roller members and at least one pinch roller member adapted to be brought into contact with said platen member for further feeding said top sheet having been fed by said feeding means; and controlling means for controlling said feeding means and said another feeding means in such a manner that the amount of said sheet fed by said another feeding means becomes larger than that fed by said feeding means in case that both said feeding means and said another feeding means feed the sheet, while controlling said feeding means in case said another feeding means is not operated, so as to feed the topsheet a predetermined amount required for flattening any occurring sag between said pair of roller members and said platen member.

2. The sheet feeding apparatus according to claim 1, wherein said controlling means further controls said feeding means and said another feeding means so as to stop the feeding operation in case that said leading edge of said topsheet reaches a predetermined position designated at downstream side of said platen member, and which further comprises a paper bail member arranged to be brought into contact with said platen member in case that said leading edge reaches said predetermined position, whereby said topsheet is nipped between said platen member and said paper bail member when said leading edge reaches at said predetermined position.

3. A sheet feeding apparatus, comprising:

storing means for storing more than one cut-type sheet in a stacked state;

feeding means including a pair of roller members for feeding the topsheet of said stacked sheet only in a predetermined direction;

a predetermined gear mechanism;

another feeding means, provided at a downstream side of said feeding means in said predetermined direction and arranged to be driven by said predetermined gear mechanism, comprising at least a driving source for generating driving power and at least two gear members arranged to be brought into engagement for transmitting the driving power and a platen member rotatable in said predetermined direction and an opposite direction thereto for further feeding said topsheet having been fed by said feeding means; and controlling means for controlling said another feeding means so as to feed said topsheet with respect to sag which occurred between said pair of roller members and said platen member if said topsheet has been backwardly fed and further forwardly fed by said platen member, said sag being set so as to drive said another feeding means in said predetermined direction through elasticity of said cut-type sheet.

4. The sheet feeding apparatus according to claim 3, wherein said storing means comprises a hopper member capable of storing a plurality of said cut-type sheets in a stacked state, and which further comprises a feed roller member, arranged to be provided on said hopper member and to be brought into contact with said topsheet, for feeding said topsheet in said predetermined direction and at least one pinch roller member arranged to be brought into contact with said platen member for further feeding said topsheet having been fed by said pair of roller members.

5. The sheet feeding apparatus according to claim 3, wherein said predetermined gear mechanism comprises at least a motor for generating driving source and a pair of gear members respectively provided on rotation shafts of said motor and said platen member, said gear members being adapted to be brought into engagement with a predetermined backlash, and wherein said controlling means controls said another feeding means so as to feed said topsheet for an amount which is small in said backlash comparing with the desired amount.

6. The sheet feeding apparatus according to claim 3, which further comprises a paper bail member arranged to be brought into contact with said platen member in case that a leading edge of said topsheet reaches a predetermined position designated at downstream side of said platen member, whereby said topsheet is nipped between said platen member and said paper bail member when said leading edge reaches at said predetermined position.

7. The sheet feeding apparatus according to claim 4, wherein said controlling means controls said feeding means in such a manner that sag is occurred between said pair of roller members and said platen member in case that a leading edge of said topsheet is inserted between said platen member and said pinch roller member.

8. A printing apparatus, comprising:

storing means for storing more than one cut-type sheet on which a printing operation is to be executed in a stacked state;

feeding means including a pair of roller members for feeding the topsheet of said stacked sheet only in a predetermined direction;

another feeding means, provided at downstream side of said feeding means in said predetermined direction, including a platen member rotatable in said predetermined direction and an opposite direction thereto for further feeding said topsheet having been fed by said feeding means, whereby sag is occurred between said pair of roller members and said platen member when said topsheet is backwardly fed by said platen member;

printing means for printing the desired character and/or symbol data on said topsheet having been fed by said platen member and located at a predetermined position; and controlling means for controlling said feeding means and said another feeding means in such a manner that the sag is removed as said top sheet is fed in case that said topsheet is backwardly fed and further forwardly fed after the printing operation.

9. The printing apparatus according to claim 8, wherein said printing means comprises a printing head member connected to a ribbon cassette having at least one printing ribbon.

10. The printing apparatus according to claim 8, wherein said controlling means controls said feeding means so as to feed said topsheet in a predetermined amount less than that of said another feeding means.

11. The printing apparatus according to claim 10, wherein said controlling means controls said feeding means and said another feeding means so as to feed said topsheet in accordance with a relationship defined by a following equation, $$l=n-m$$

where, l: an amount of feeding by said feeding means, m: an amount of backward feeding after the printing operation, and n: an amount of feeding by said another feeding means.

12. The printing apparatus according to claim 11, wherein said controlling means further controls said feeding means so as not to feed said topsheet in case that the following relationship is satisfied, $$n<m$$

whereby said topsheet is not fed by said feeding means in case that the amount of feeding by said another feeding means is smaller than the amount of backward feeding after the printing operation.

13. The printing apparatus according to claim 8, wherein said storing means comprises a hopper member capable of storing a plurality of said cut-type sheets in a stacked state, and which further comprises a feed roller member, arranged to be provided on said hopper member and to be brought into contact with said topsheet, for feeding said topsheet in said predetermined direction and at least one pinch roller member arranged to be brought into contact with said platen member for further feeding said topsheet having been fed by said pair of roller members.

14. The printing apparatus according to claim 8, which further comprises a paper bail member arranged to be brought into contact with said platen member in case that said topsheet is located at said predetermined position.

* * * * *